United States Patent [19]

Birmingham

[11] Patent Number: 4,802,669

[45] Date of Patent: Feb. 7, 1989

[54] BASEBALL TRAINING DEVICE

[76] Inventor: Peter C. Birmingham, 117 Pumpkin La., Syracuse, N.Y. 13219

[21] Appl. No.: 107,559

[22] Filed: Oct. 13, 1987

[51] Int. Cl.[4] ..... A63B 71/02

[52] U.S. Cl. ..... 273/26 C

[58] Field of Search ..... 273/26 C, 26 R, 76, 273/212, 67 B, 76, 30, 67 R; 2/20

[56] References Cited

U.S. PATENT DOCUMENTS

| | | | |
|---|---|---|---|
| 243,132 | 1/1877 | Lowrey | 379/227 |
| 368,724 | 8/1887 | Loucks | 192/54 |
| 819,250 | 5/1906 | Paget | 273/67 B |
| 1,402,799 | 1/1922 | Ryan | 273/67 B |
| 1,558,666 | 10/1925 | Brewer et al. | 273/67 B |
| 1,562,176 | 11/1925 | Latina | 273/212 |
| 1,868,822 | 7/1932 | Goldkind | 2/20 |
| 2,311,546 | 2/1943 | Hurt | 273/76 |
| 2,328,366 | 8/1943 | Timmerman | 273/76 |
| 2,547,388 | 12/1948 | Griffin | 2/30 |
| 2,695,999 | 12/1954 | Arnold | 2/20 |
| 2,952,021 | 9/1960 | Finn | 2/20 |
| 2,987,316 | 6/1961 | Butera | 273/76 |
| 3,735,442 | 5/1973 | Lukas | 2/20 |
| 4,121,824 | 10/1978 | Hirschfield | 273/26 C |
| 4,208,051 | 6/1980 | Robertson | 273/26 C |
| 4,387,895 | 6/1983 | Steel | 273/67 B |
| 4,516,774 | 5/1985 | Nankivell | 273/67 B |
| 4,617,684 | 10/1986 | Green | 2/20 |

FOREIGN PATENT DOCUMENTS

| | | | |
|---|---|---|---|
| 12632 | of 1890 | United Kingdom | 273/67 B |
| 693280 | 6/1953 | United Kingdom | 273/76 |

*Primary Examiner*—Richard C. Pinkham
*Assistant Examiner*—T. Brown
*Attorney, Agent, or Firm*—Wall and Roehrig

[57] ABSTRACT

A baseball training device that is worn upon a fielder's glove hand for aiding the wearer in developing proper fielding skills. The device has a thick triangular shaped pad that encompasses the entire hand. Webbing on the back surface of the pad encircles the thumb and first three fingers of the glove hand to position the apex of the pad over the wearer's wrist and the base leg of the pad extended beyond the wearer's fingertips. The pad is comprised of a resilient material that will deform upon being struck by a ball over the heel region of the hand to provide the ball sufficient residency time on the pad to enable the wearer to bring his or her or other hand over the ball and thus complete the catch. Balls striking the pad in other areas are provided little or no residency time and are thus more difficult to field.

4 Claims, 1 Drawing Sheet

BASEBALL TRAINING DEVICE

BACKGROUND OF THE INVENTION

This invention relates to a baseball training device and, in particular, to a device for training a ball player to develop fielding skills.

The term baseball, as herein used, shall be broad enough to encompass both hardball and softball sports of all types wherein a participant uses a glove or mitt to field a ball whether struck by a bat or thrown by another player. Initially, in the early days of baseball, the gloves were not much more than thin leather strips that were wrapped about the player's catching hand as described in U.S. Pat. No. 368,724. Because of the lack of protection, fielders were forced to catch balls using both hands with the main impact of the ball being absorbed in the heel of the catching hand. Accordingly, the fielder had to develop well grounded fielding skills or risk making numerous errors or even suffering serious hand and finger injuries.

Fielding gloves, however, have evolved over the years which offer the wearer greater protection and provide deep, wide pockets that enable a player to catch, or more correctly entrap, the ball within the glove. Young ball players therefore have come to rely more and more on their equipment and less upon their skills when fielding. As a consequence, these players fail to develop the basic mechanics necessary to skillfully play the game. In fact, this reliance on equipment causes young players to develop poor fielding habits, the most prevalent of which is catching or fielding balls with only the glove hand.

Some coaches, in order to train young ball players in fielding balls or turning double plays, have taped flat boards to the fielders glove hand. The board forces the player to use two hands when catching or trapping a ball and to receive the ball in the heel area of the hand. It has been found, however, that the ball rebounds rapidly upon striking the hard board so that only players possessing the highest of natural skills can use the device. Those having lesser skills can not master the use of the board and soon become discouraged.

OBJECTS OF THE INVENTION

It is therefore an object of the present invention to improve training devices for teaching a ball player to improve his or her fielding skills.

A further object of the present invention is to teach a fielder to receive a ball in the heel of his or her glove hand.

A still further object of the present invention is to teach a young ball player or a player with poor fielding habits to use two hands when fielding or catching a baseball.

Yet another object of the present invention is to encourage rather than discourage ball players to develop good fielding techniques.

These and other objects of the present invention are attained by a training device that includes a triangular shaped pad of thick resilient foam that encompasses the entire glove hand of the wearer. The pad has loops on the back for encircling the thumb and the first three fingers on the glove hand so that the middle finger is aligned along the axis of the triangle with the apex of the pad being positioned over the wrist and the base leg of the pad extended outwardly beyond the fingertips. The resiliency of the pad is such that only balls striking the pad over the well supported heel area of the hand are provided any residency time on the pad during which the player can bring the other hand over the ball and complete the catch. The device thus teaches the wearer to both field a ball in the heel of the glove hand and to use both hands when fielding.

BRIEF DESCRIPTION OF THE DRAWING

The above and many other objects, features, and advantages of this invention will be more fully understood from the following description of a preferred embodiment, when considered in connection with the accompanying drawings wherein.

DESCRIPTION OF THE INVENTION

Figure 1:
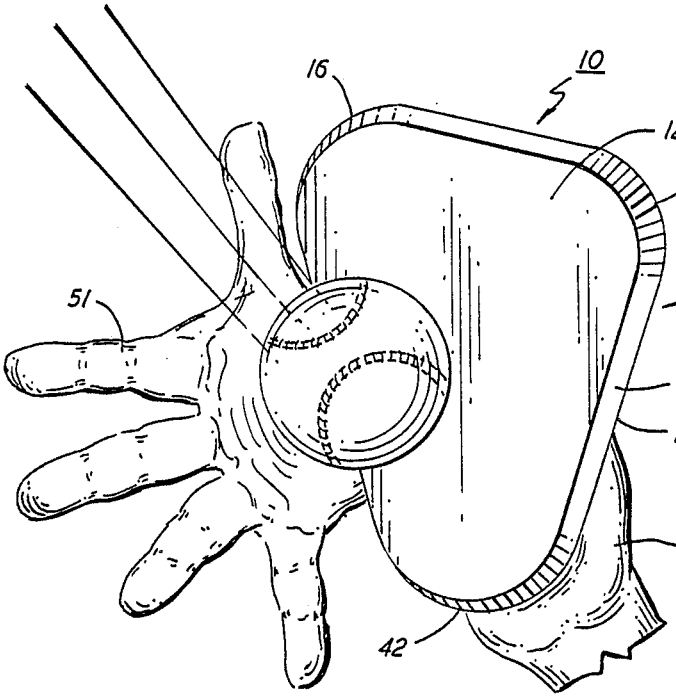
FIG. 1 is a front view of the baseball training device of the present invention depicting proper hand motion and ball placement.

Referring now to the drawings, there is shown a baseball training device 10 for training ball players to develop proper fielding techniques. Specifically, the baseball training device will aid all fielders in developing proper mechanics when fielding ground balls and in developing proper hand action when turning a double play. It will also aid catchers in developing proper blocking skills.

The baseball training device includes a pad 11 constructed with a front surface 12, a back surface 13 that is parallel and coexistent with the front surface, and a side wall 14. The device is formed of a single piece of uniformly resilient foam to form a thick self supporting triangular shaped member having rounded corners 16. The surface area of the pad is large enough so that the pad completely encompasses the entire hand of the wearer and extends outward from the hand in all directions.

Figure 2:
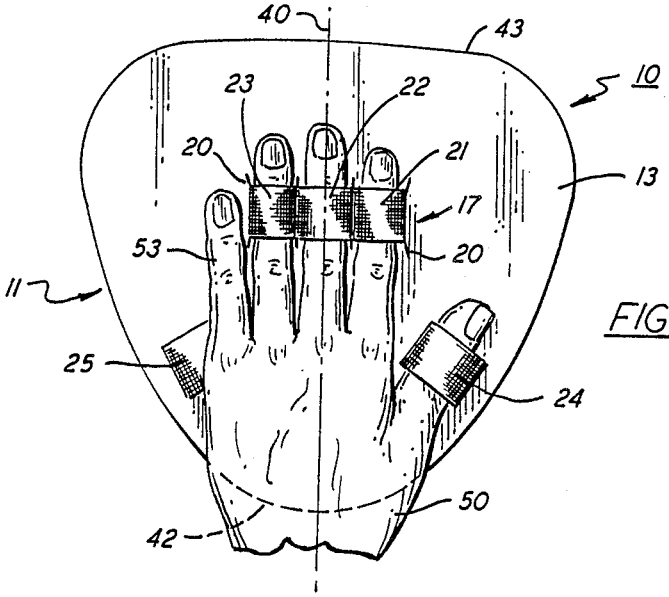
FIG. 2 is a back view of the device shown in FIG. 1 depicting the finger loops for holding the glove hand to the device.
Figure 3:
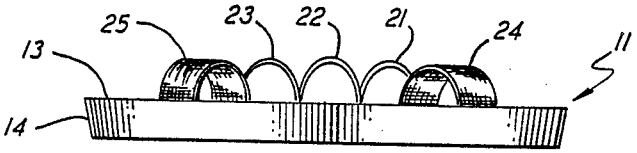
FIG. 3 is a top view of the device shown in FIG. 1.

As seen in FIG. 2, fingergrips 17 of elasticized attachment members are attached to the back surface 13 of the training device. The fingergrips are comprised of individual loops 21–25 for encircling the thumb and first three fingers on the wearer's glove hand. The end of each loop is inserted into a slot 20 cut into the back of the pad and held in the slot by any suitable adhesive. A series of three finger loops 21–23 are consecutively grouped in the middle of the training device and two diagonal thumb loops 24 and 25 are positioned to either side and below the finger loops. Even though there are five loops provided, only four are utilized at any one time by the wearer. The little finger of the glove hand is not captured in the attachment members and simply rests on the back of the pad as shown in FIG. 2. The two opposing thumb loops enable the training device to be readily adaptable to either the right or left hand.

The training device of the present invention is specifically designed to teach players who do not have exceptional talent to properly field a ball in the heel area of the glove hand 50 and to use two hands when fielding as illustrated in FIG. 1. Through use of the device, an average player can learn the proper mechanics involved in fielding and thus become a better, all around player. As noted above, the pad of the device is made of a uniformly resilient material. The resiliency of the pad is such that the pad will deform when struck in the heel area by a ball travelling at a moderate speed. By permitting the pad to deform slightly in this critical area, the ball will reside for a short period of time (residency time) on the pad during which the player can bring his or her other hand 51 over the ball to complete a catch or, in the case of a catcher, block the ball. It should be noted, however, that a ball striking any other less supported area outside the heel area will not cause the pad to appreciably deform and, accordingly, the ball will quickly fall away or rebound from the pad before the other hand can be brought into play.

The finger positioning on the back of the device also plays an important part in focusing the wearer's attention on the critical heel area. As seen in FIG. 2, the center loop 22 of the finger loop series is aligned along the axis 40 of the triangular shaped pad. Because the axis bisects apex 42 and the base leg 43 of the triangle, the pad will be generally centered upon the wearer's hand. The other two finger loops are mounted in contiguous relation with the center loop to closely group the fingers about the axis of the pad and position the heel of the hand toward the bottom of the pad. The small finger 53 of the hand is thus forced to rest in an unsupported condition against the back of the pad. Any balls striking the pad on either side of the axis 40 will therefore tend to turn or twist the pad about the axis and prevent the pad from deforming. Here again, the ball is provided little or no residency time on the pad and will most likely be dropped by the player before he can make a play.

By positioning the heel of the hand close to the apex of the pad and the pad being slightly resilient, the player's hand will cup the ball to some extent when a ball strikes the heel region. This tells the wearer almost immediately that the glove hand has successfully carried out its task and signals the player to bring the other hand into play within the short residency time allowed. With practice, the player will be making two handed catches in one fluid motion almost immediately upon the ball striking the heel area. This smooth motion soon becomes a habit which is then carried over into actual game situations, thus leading to less errors and all around better play.

Preferably, the pad of the device is made from a high density foam, having closed cells whereby the device will be relatively impervious to dirt and water.

While this invention has been described in detail with respect to a single preferred embodiment, it should be recognized that the invention is not limited to that embodiment, and that many modifications and variations thereon could be carried out by those of skill in the art without departing from the scope and spirit of this invention, which is to be ascertained from the appended claims.

What is claimed is:

1. A baseball training device that is worn over the glove hand of a player to aid the wearer in developing good fielding skills that includes a triangular shaped uniformly resilient pad having planar front and back surfaces, said pad having hand attachment means on the back surface thereof for encircling the thumb and first three fingers of the glove hand which will align the middle finger along an axis of the triangle with the apex of the pad being positioned over the wrist, the edge of the pad extending outwardly beyond the tips of the fingers and side edges of the user's hand, said pad having a resilience such that when worn on the hand of a player a ball striking said front surface backed by a wearer's hand heel portion will deform to a greater extent than the remaining portion of the pad and will have a longer surface contact time on said pad than balls striking the remaining portion of said pad whereby a wearer is afforded greater time in which to place his other hand over a ball when making a catch.

2. The training device of claim 1 wherein said attachment means further includes a pair of thumb loops diagonally disposed to either side of the finger loops whereby the device can be worn on either hand.

3. The training device of claim 2 wherein attachment members means is formed of an elastic material for biasing the thumb and fingers against the back of the pad.

4. The training device of claim 1 wherein the pad is formed of a high density foam material having closed cells whereby the pad is impervious to dirt and water.

* * * * *